United States Patent [19]

Bachle

[11] 4,027,519

[45] June 7, 1977

[54] MEANS AND METHOD FOR REDUCING THE PERIMETER OF A HOLLOW THIN WALLED MEMBER

[75] Inventor: Walter Bachle, Harwinton, Conn.

[73] Assignee: Thomas & Betts Corporation, Elizabeth, N.J.

[22] Filed: Sept. 22, 1976

[21] Appl. No.: 725,627

[52] U.S. Cl. ..... 72/367; 29/517; 72/410; 72/412; 72/470

[51] Int. Cl.[2] ..... B21D 37/10

[58] Field of Search ..... 72/367, 409, 410, 412, 72/415, 416, 470; 29/517

[56] References Cited

UNITED STATES PATENTS

| | | | |
|---|---|---|---|
| 2,576,528 | 11/1951 | Matthysse | 29/517 |
| 2,740,102 | 3/1953 | Paules | 29/630 A |
| 2,878,854 | 3/1959 | Batcheller | 29/517 |
| 2,958,929 | 11/1960 | Vineberg | 29/517 |
| 3,719,985 | 3/1973 | Federspill | 29/417 |

FOREIGN PATENTS OR APPLICATIONS

| | | | |
|---|---|---|---|
| 1,951,719 | 10/1969 | Germany | 72/412 |
| 645,210 | 9/1962 | Italy | 29/517 |
| 372,543 | 5/1932 | United Kingdom | 72/367 |

*Primary Examiner*—C.W. Lanham
*Assistant Examiner*—Gene P. Crosby
*Attorney, Agent, or Firm*—David Teschner; Jesse Woldman

[57] ABSTRACT

The wall of a thin walled hollow member such as the ferrule portion of an electrical terminal or the like is subjected to a longitudinal pinching force which may be applied by one or more pair of spaced parallel elongate forming surfaces at selective locations along the length of the perimeter of the thin walled member to produce one or more obliquely angled double thickness fins which are then subjected to an inwardly directed radial force causing the fins to be folded back against the outer surface of the hollow member which is thus tightly contracted about a further member located within the hollow member.

12 Claims, 11 Drawing Figures

MEANS AND METHOD FOR REDUCING THE PERIMETER OF A HOLLOW THIN WALLED MEMBER

BACKGROUND OF THE INVENTION

1. Field of the Invention

The invention is directed to the field of metal forming means and methods and principally to a means and method for working hollow tubular members.

2. Description of the Prior Art

In many cases it is necessary or desirable to encapsulate or enclose the end of an elongate member in a tubular sleeve for protection or for convenience in subsequent handling and use. For example, the end of a severed portion of stranded electrical cable may require such sleeve where the end is to be inserted into the barrel of an electrical connector for subsequent connection thereto. In such cases, the inside diameter of the connector barrel is suitably sized to provide a close sliding fit over a particlar cable to insure maximum electrical integrity of the final joint. If, however, the sleeve is applied to the cable end by means of a conventional crimping operation, severe deformation of the sleeve and cable end would occur, causing a poor fit within the connector barrel, and a resultant undesirable decrease in the mechanical and electrical integrity of the final joint. Various means and methods for squeezing or crimping sleeve-like members about a further element have been disclosed in the prior art, and are exemplified in U.S. Pat. No. 2,576,528 issued to Matthysse on Nov. 27, 1951; U.S. Pat. No. 2,740,102 issued to Paules on Mar. 27, 1956; U.S. Pat. No. 2,958,928 issued to Vineberg on Nov. 8, 1960; and U.S. Pat. No. 3,719,985 issued to Federspill on Mar. 13, 1973. Such prior art means and methods, however, generally result in the formation of a longitudinally extending lip or lobe which extends beyond the outer periphery of the sleeve as a discontinuity in the cylindrical form of the sleeve. In each case the folded excess material is oriented along a diametrical axis and normal to the outer periphery of the sleeve due to the inherent nature of the crimping or forming operation, so that any attempt to force the lip or lobe back into the confines of the perimeter of the sleeve by an inwardly directed radial force will result either in an opening of the fold or the creation of an additional lobe or flash line at another location on the sleeve, thus again disturbing and distorting both the external and internal cylindrical size and shape of the sleeve. Such operation may also result in splitting of the cylinder due to the severe stress created by the additional distortion and deformation of the sleeve.

SUMMARY OF THE INVENTION

The invention overcomes the limitations and difficulties noted above with respect to prior art means and methods by providing a die means and method for creating at least one obliquely angled folded tab or fin which will safely, reliably, and efficiently reduce the perimeter of a thin walled hollow member and insure a constant uniform compression about an engaged member enclosed therewithin. The method of the invention includes the steps of externally pinching a longitudinal section of the wall of the sleeve between a pair of spaced parallel planar surfaces oriented at an oblique angle to the radial axis of the sleeve and consequently forming a longitudinally extending obliquely angled folded fin thereat which may then be subjected to an inwardly directed radial force causing the fin to rotate about its base and fold back towards the outer surface of the sleeve to prevent the pinched section of the wall from reopening. A pair of such obliquely angled fins located at substantially diametrically opposed locations on the periphery of the sleeve may be created in like manner to provide increased peripheral reduction of the sleeve. Also disclosed are die means for rapidly and conveniently accomplishing the fin forming and folding operation wherein a pair of dies are provided with one or more pair of fin forming surfaces, each pair being arranged in spaced parallel relationship and planarly oriented at an oblique angle to the axis of movement of the die members. Upon closure of the die members, a longitudinal segment of the wall of the sleeve is pinched between the fin forming surfaces to provide a folded fin extending outwardly from the perimeter of the sleeve at an oblique angle to the radial axis of the sleeve. The dies are then opened and the sleeve rotated approximately 90° within the die members which are then reclosed to cause the fins to be folded inwardly against the outer surface of the sleeve, thus completing the operation. It is therefore an object of this invention to provide a means and method for reducing the perimeter of a hollow thin walled member.

It is another object of this invention to provide a method for securely fastening a hollow thin walled member about an elongated article.

It is a further object of this invention to provide a method for securely fastening an electrically conductive sleeve about a given end of a stranded electrical conductor.

It is yet another object of this invention to provide a method and means for reducing the perimeter of a cylindrical thin walled hollow member while maintaining its cylindrical shape after reduction.

It is still a further object of this invention to provide a means and method for uniformly reducing the perimeter of a thin walled hollow member along its entire length.

It is yet a further object of this invention to provide forming means for producing perimeter reducing fins from the body of a thin walled hollow member.

It is yet another object of this invention to provide a method for insuring that perimeter reducing fins are properly folded back into the body of a thin walled hollow member from which such fins are generated.

Other objects and features of the invention will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
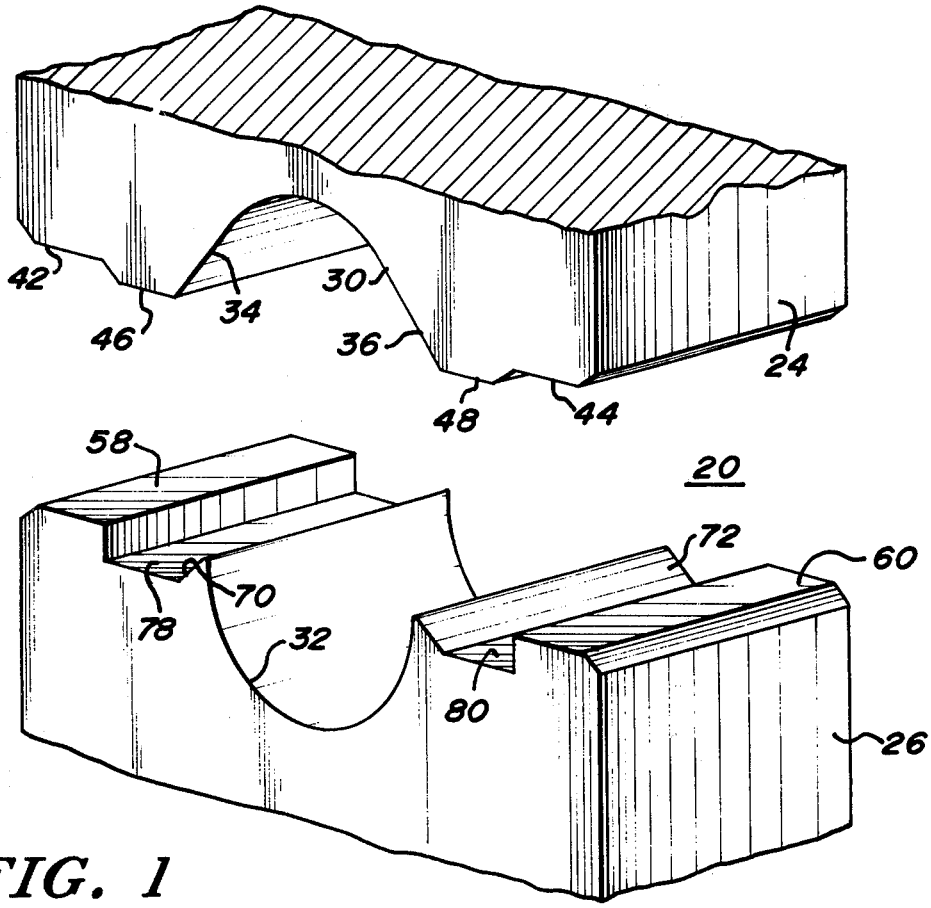
FIG. 1 is a fragmentary perspective view of die means constructed in accordance with the concepts of the invention.
Figure 2:
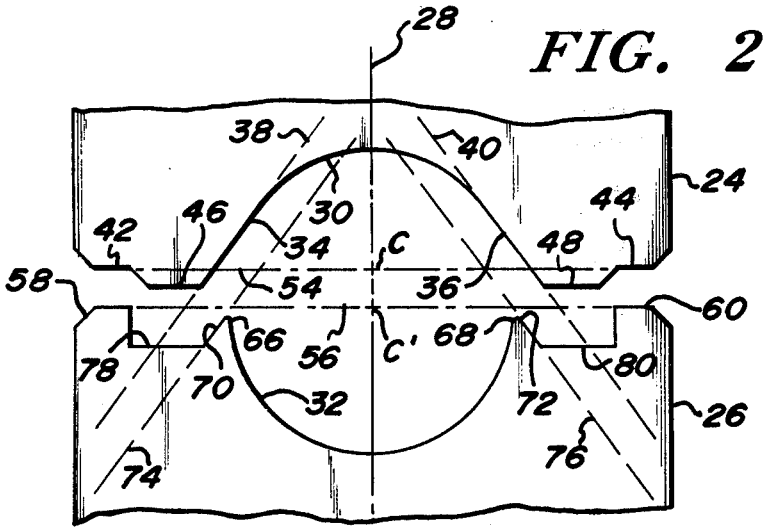
FIG. 2 is a fragmentary front elevational view of the die means of FIG. 1 in a partially opened state.
Figure 3:
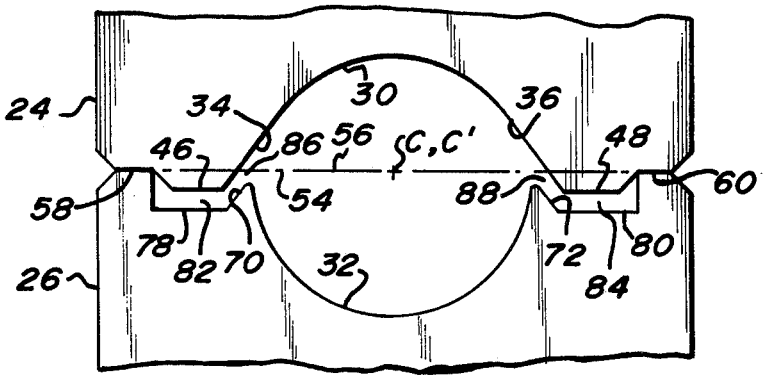
FIG. 3 is a further fragmentary front elevational view of the die means of FIG. 1 in a closed state.
Figure 4:
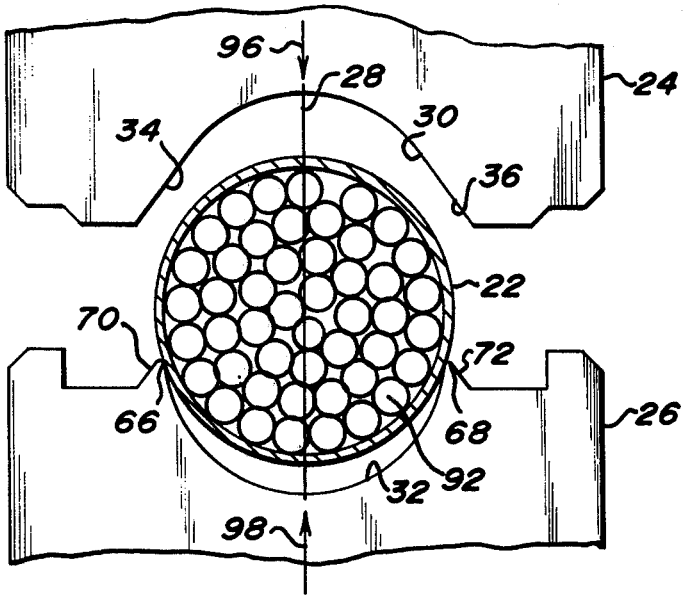
FIG. 4 is a fragmentary front elevational view, partly in section, showing a hollow thin walled member containing a portion of a stranded conductor seated between the two halves of the die means of FIG. 1.
Figure 5:
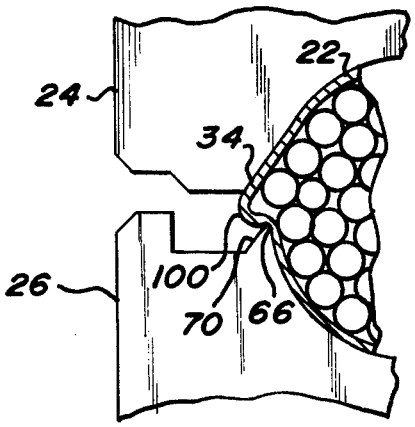
FIG. 5 is a fragmentary front elevational view, partly in section, showing the formation of a perimeter reducing fin in accordance with the concepts of the invention.
Figure 6:
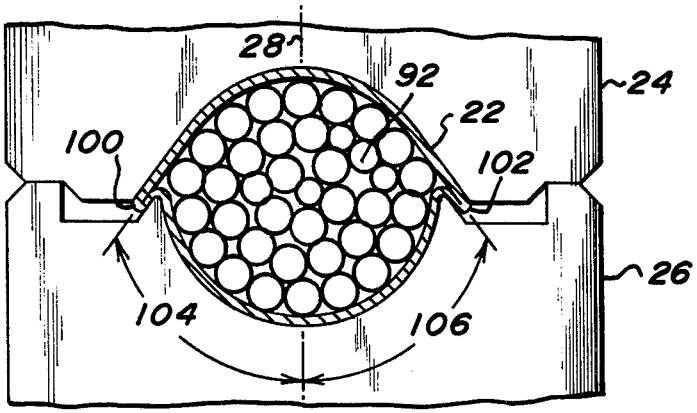
FIG. 6 is a fragmentary front elevational view, partly in section, showing the formation of perimeter reducing fins generated from the body of a thin walled hollow member in accordance with the concepts of the invention and employing the die means of FIG. 1.
Figure 7:
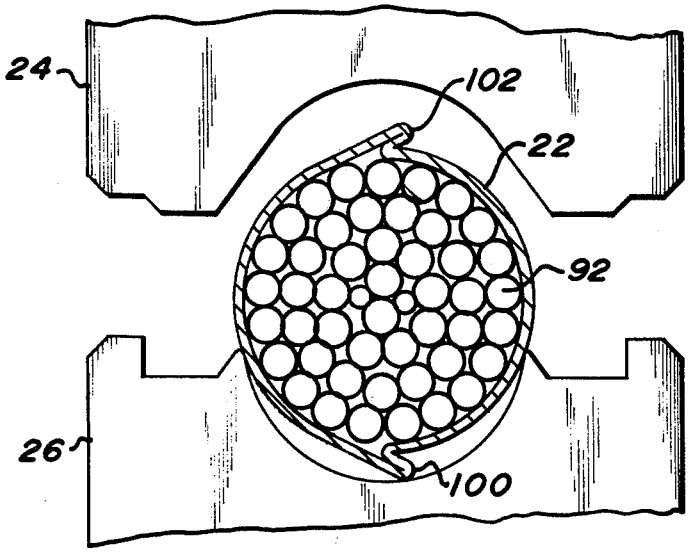
FIG. 7 is a fragmentary front elevational view, partly in section, similar to FIG. 6, showing a further step in the reduction of the perimeter of a thin walled hollow member in acordance with the concepts of the invention.
Figure 8:
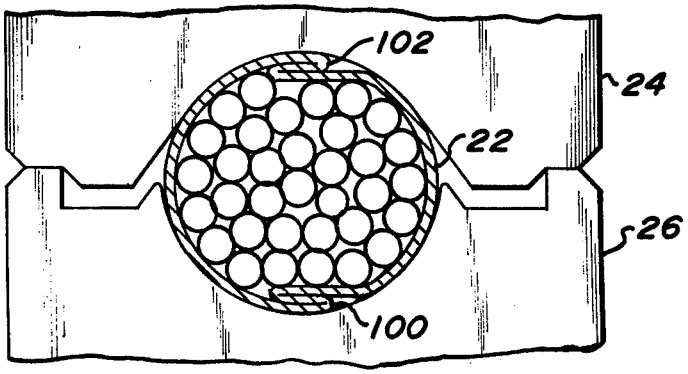
FIG. 8 is a fragmentary front elevational view, partly in section, showing a further step in the reduction of the perimeter of a thin walled hollow member in accordance with the concepts of the invention.
Figure 9:
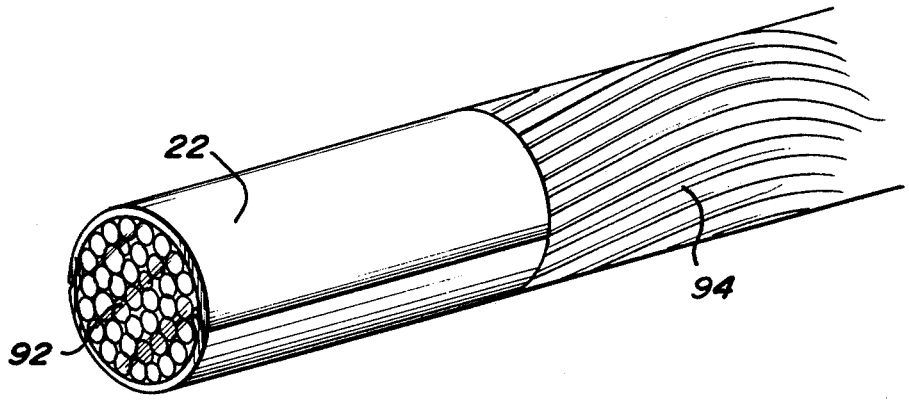
FIG. 9 is a fragmentary perspective view, partly in section, showing the engagement of a thin walled hollow member about one end of a stranded electrical conductor in acordance with the concepts of the invention.

Turning now to FIGS. 1 through 9 there is shown a die means 20 constructed in accordance with the concepts of the invention and arranged to produce perimeter reducing obliquely angled fins from the body of a tin walled hollow member 22 (FIG. 4). The die means 20 comprises a first or upper die member 24 and a second or lower die member 26, the members 24 and 26 being suitably arranged to be held in a conventional die enclosure or press (not shown) for movement towards and away from one another along a central axis 28 (FIG. 2). Each of the die members 24 and 26 comprises an interior surface 30 and 32, respectively, each of the surfaces 30 and 32 being shown as having an arcuate segment essentially semicylindrical to receive a similarly configured sleeve or tube therebetween. It should be understood, however, that the exact shape of the arcuate segments of the surfaces 30 and 32 may be varied somewhat to receive oblong, elliptical, or other similar tubular configurations without departing from the spirit of the invention and within the concepts herein disclosed. As may be further seen in FIG. 2, the surface 30 of die member 24 further includes essentially planar surface portions 34 and 36 contiguous with the central arcuate segment of surface 30. The planar surface portion 34 is shown inclined along an axis 38 and the planar surface portion 36 is shown inclined along an axis 40, the axes 38 and 40 being tangent to the arcuate portion of the surface 30 and oriented at an oblique angle to the axis of movement 28 of the die members 24 and 26. The included angle between each of the axes 38 and 40 and the axis 28 is preferably less than 45° for purposes which will be described in greater detail hereafter. Each of the planar surface portions 34 and 36 communicates with a respective shoulder portion 42, 44, each of which includes a respective protruding or stepped portion 46, 48. Each of the planar surface portions 34 and 36 subtends an arc peferably of about 10° to 30°, as measured from the radial center C (FIG. 2) of the arcuate portion of surface 30. It will also be noted that the radial center C is coincident with an axis 54 which is aligned with the shoulder portions 42 and 44. The lower or second die member 26 is provided with mating surfaces essentially complementary to those of die member 24 so that both members may be brough together to provide cooperating surfaces as shown generally in FIG. 3. Specifically, the interior surface 32 of die member 26 has a radius of curvature commensurate with the arcuate portion of surface 30, the radial center of surface 32 being indicated by letter C′, the radial center C′ being shown as coincident with an axis 56 which is aligned with the opposed shoulder portions 58 and 60 of die member 26. The portions 58 and 60 of die member 26 are arranged to abut the shoulder portions 42 and 44 of the die member 24 as the die members are brought together, wherein the radial centers C and C′ and axes 54 and 56 are caused to coincide with one another, producing a single radial center with respect to the arcuate portions of surfaces 30 and 32 as shown in FIG. 3. As further shown in FIG. 2, surface 32 of die member 26 terminates at either end in a respective peaked portion 66, 68. Inclined outwardly and away from the peaked portions 66 and 68 are respective planar surface portions 70 and 72. As further illustrated in FIG. 2, the surface 70 is inclined along an axis 74 which is substantially parallel to axis 38 while the surface 72 is inclined along an axis 76 which is substantially parallel to axis 40. Accordingly, the surfaces 34 and 70 provide a first pair of parallel surfaces, and the surfaces 36 and 72 provide a second pair of parallel surfaces, each pair being located at substantially diametrically opposed positions with respect to the radial center C of the die member 24. The shoulder portion 58 also includes a recessed portion 78, while a similar recessed portion 80 is provided in the shoulder portion 60 of die member 26. The depth of the recessed portions 78 and 80 are such that a respective longitudinally extending gap or trough 82, 84 is formed between the portions 46 and 78, and portions 48 and 80, as the die members 24 and 26 are brought together in the manner shown in FIG. 3. A gap or trough 86 contiguous with trough 82 is provided between the planar surfaces 34 and 70, and a gap or trough 88 contiguous with trough 84 is provided between surfaces 36 and 72 as the die members 24 and 26 are positioned in their closed state essentially as shown in FIG. 3. The troughs 86 and 88 may each have a width generally equal to the respective adjacent troughs 82 and 84 to provide a uniform clearance therebetween. The die members 24 and 26, as thus constructed, afford a means for reforming the thin walled hollow member 22, which may comprise an electrically conductive sleeve, such as illustrated in FIG 9, about an end portion 92 of a stranded electrical conductor 94 to maintain the strands in a compact bundle for insertion in a barrel or ferrule portion of an electrical terminal (not shown). As illustrated in FIG. 4, the member 22 is positioned over the end portion 92 of an elongate member such as the stranded electrical conductor 94 and placed within the die member 26. To insure that the member 22 is properly reformed in the die means 20, the arcuate portions of the surfaces 30 and 32 should have a radius of curvature somewhat less than that of the member 22. Thus, upon the initial placement of the member 22 in the die member 26, the member 22 will take a position substantially as shown in FIG. 4, that is, it will tend to be supported by the peaked portions 66 and 68 of the die member 26 and away from the arcuate surface 32. The die members 24 and 26 are then brought together along the axis of movement 28 in the respective directions shown by the arrows 96 and 98. As the die members 24 and 26 approach one another, the member 22 is forced between the surfaces 30 and 32. The squeezing effect causes the wall of member 22 to collapse somewhat under the pressure of the die members. Since there are provided opposed open areas in the general location of the surfaces 34 and 70 at the left side of the die members 24 and 26, as viewed in FIG. 2, and in the general location of the surfaces 36 and 72 at the right side of die members 24 and 26, as viewed in FIG. 2, the wall of the member 22 will tend to extrude outwardly into such open areas substantially as shown in FIG. 5 with respect to the left side of the assembly, although it should be understood that a similar deformation will occur on the right side, although now shown therein. As depicted in FIG. 5, a portion of the wall of the member 22 is pinched between the planar surfaces 34 and 70 as the peaked portion 66 engages the member 22. The pinching effect becomes more pronounced as the die members 24 and 26 are moved closer together so that a longitudinal rib or fin 100 begins to form along the length of the member 22 which, in effect, tends to reduce the perimeter of the member 22. The orientation and shape of the fin 100 will, of course, be governed by the corresponding orientation and shape of the fin forming surfaces 34 and 70 which, as previously described, are oriented at an oblique angle to a horizontal plane passing diametrically between the die members generally normal to the axis of movement 28. It should be understood that the references to the mode of operation pertaining to the left side of the structure as viewed in FIG. 5 apply equally as well to the surfaces 38 and 72 on the right side of the structure and that a similar fin forming operation will occur thereat. Upon full closure of the die members 24 and 26, as shown in FIG. 6, there are thus produced the fin 100 and a corresponding fin 102, each comprising a double thickness wall portion of the member 22. The cylindrical configuration of the member 22 has been substantially preserved throughout, there being only a slight disruption of the cylindrical configuration in the area of the fins 100 and 102. As further illustrated in FIG. 6, each of the fins 100 and 102 is oriented at an oblique angle to the axis of movement 28, the respective angles being indicated by the numerals 104 and 106. As mentioned heretofore, each of the angles 104 and 106 is preferably less than 45°. It will also be noted that the fins 100 and 102 are aligned along respective planes essentially tangent to the arcuate portion of the surface 30 of die member 24. To complete the perimenter reducing operation, the die members 24 and 26 are opened and the member 22 together with the engaged end portion 92 is rotated about its longitudinal axis approximately 90° and replaced within the die members 24 and 26 substantially as shown in FIG. 7. The die members 24 and 26 are then brought together again whereby the fins 100 and 102 are urged radially inwardly and folded against the outer surface of the member 22 substantially as shown in FIG. 8. It will be noted that the respective areas of the member 22 directly beneath the fins 100 and 102 are caused to deform inwardly slightly under the compressive force of the die members as applied to the fins 100 and 102, thus producing a final generally cylindrical cross sectional shape roughly duplicative of the original cylindrical shape of the member 22 but selectively reduced in diameter. The folded fins 100 and 102 are thus highly resistant to reopening and thereby insure that the strands of the cable 94 are securely bound or bundled preparatory to further use, storage, or transportation. It should be noted that the oblique angular orientation of the fins 100 and 102 relative to a diametrical axis joining them precludes the possibility that the double thickness fold will be reopened or otherwise undesirably deformed during the final folding operation depicted in FIGS. 7 and 8 since the longitudinal axis of each folded fin is sufficiently oriented away from the radial line of force generated by the closing die members so that the major force vector operates against the outwardly facing side of each fin rather than against the apex thereof.

Figure 10:
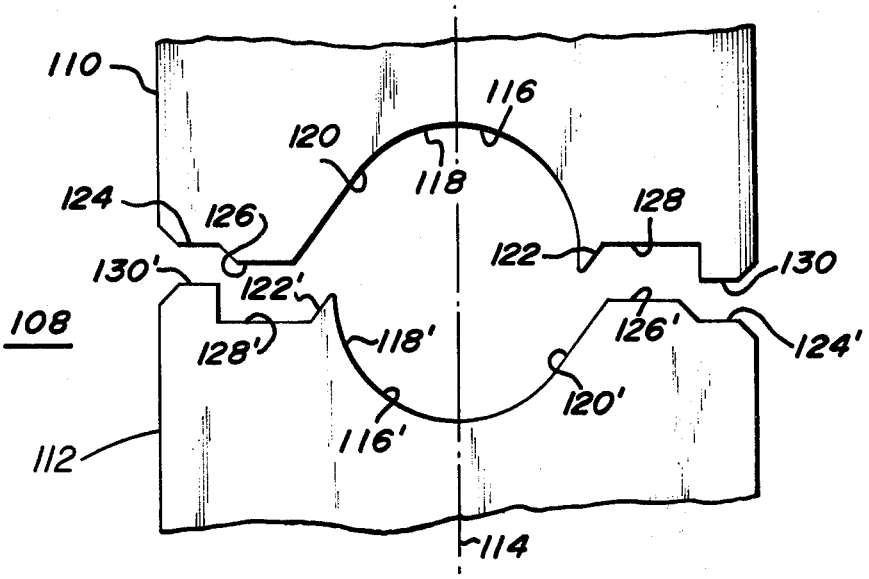
FIG. 10 is a fragmentary front elevational view of a further embodiment of a die means constructed in accordance with the concepts of the invention.
Figure 11:
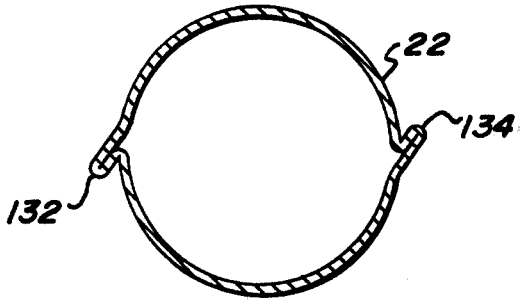
FIG. 11 is a front elevational view, showing a thin walled hollow member having perimeter reducing fins generated by the die means of FIG. 10.

Referring now to FIG. 10 there is shown a further embodiment of a die means 108 constructed in accordance with the concepts of the invention. As with the die means 20 shown in FIG. 1, the die means 108 similarly comprises two die halves or members 110 and 112 arranged to move towards and away from one another along an axis of movement 114. The die members 110 and 112 are, however, hermaphroditic, so that each is essentially a duplicate of the other. The die member 110 comprises an interior surface 116 which, to the left of the axis 114, as viewed in FIG. 10, is essentially duplicative of surface 30 of die member 24 and includes an arcuate portion 118 contiguous with a planar fin forming surface 120, the surface 120 being duplicative of surface 34. The portion of surface 116 to the right of the axis 114, as viewed in FIG. 10, has a relatively uniform radius of curvature essentially similar to surface 32 of die member 26. Outwardly of the surface 116 to the right of the axis 114, as viewed in FIG. 10, is a planar surface 122 corresponding to the surface 70 or 72 of die member 26. Portions 124, 126, 128, and 130 correspond to like portions 42, 46, 44, and 48, respectively, of the die means 20. The portions of the die member 112 which correspond to like portions of the die member 110 are identified by primed numerals corresponding to the unprimed numerals of die member 110. Use of the die means 108 in the manner described above with respect to the die means 20 will result in the production of fins 132 and 134 (FIG. 11) both of which are essentially duplicative of fins 100 and 102. However, the direction or orientation of fin 134 is complementary to that of fin 102 while the direction of orientation of fin 132 is essentially identical to that of fin 100. The fins 132 and 134 may then be folded against the exterior of member 22 in substantially the same manner as described above with respect to FIGS. 7 and 8 to produce a similar perimeter reducing structure. It should also be appreciated that although two pair of fin forming surfaces and the corresponding fins formed thereby have been shown and described, the invention is not intended to be limited thereby, and that either a single fin or more than two fins may be produced from appropriate fin forming surfaces with equal effectiveness and within the concepts herein disclosed.

The embodiments of the invention in which an exclusive property or privilege is claimed are defined as follows:

1. Die means for reducing the perimeter of a hollow thin walled member comprising: a first die member; and a second die member; said first die member and said second die member each having an arcuately shaped interior surface, said interior surface of said first die member being substantially complementary to said interior surface of said second die member, each of said first and said second die members having a shoulder portion, said shoulder portion of said first die member being arranged to abut said shoulder portion of said second die member as said first and said second die members are brought together along an axis of movement centrally bisecting said interior surfaces, said first die member having a planar first fin forming surface extending between said interior arcuate surface and said shoulder portion of said first die member, said second die member having a planar second fin forming surface extending between said interior arcuate surface and said shoulder portion of said second die member, the plane of said first fin forming surface being substantially parallel to the plane of said second fin forming surface and disposed in spaced opposing relationship to said second fin forming surface upon the closure of said first and said second die members, the planes of said first and said second fin forming surfaces being oriented at an oblique angle to a plane normal to the axis of movement of said first and said second die members and parallel to the longitudinal axis of die means, said first and said second fin forming surfaces interrupting the periphery formed by said interior arcuate surfaces of said first and said second die members and providing a gap therebetween, upon closure of said first and said second die members, for receiving a portion of the wall of a hollow thin walled member disposed between said interior arcuate surfaces of said first and said second die members, and thereby forming a double wall thickness fin thereat depending from the surface of such thin walled member along an axis substantially tangent to the surface of such thin walled member at the location of such fin.

2. Die means as defined in claim 1 wherein the included angle between said first and said second fin forming surfaces and a plane normal to the axis of movement of said first and said second die members is greater than 45°.

3. Die means as defined in claim 1 further comprising a planar third fin forming surface and a planar fourth fin forming surface, said third fin forming surface being located on said first die member in diametrically opposed relationship to said first fin forming surface, said fourth fin forming surface being located on said second die member in diametrically opposed relationship to said second fin forming surface, said third and said fourth fin forming surfaces cooperating in a manner similar to said first and said second fin forming surfaces to receive a further portion of the wall of a hollow thin walled member disposed between said first and said second die members upon the closure thereof and to form an additional double wall thickness fin thereat which similarly depends from the surface of such thin walled member along an axis substantially tangent to the surface of such thin walled member at the location of such fin.

4. Die means as defined in claim 1 wherein said first fin forming surface subtends an arc of between 10° and 30°.

5. Die means as defined in claim 1 wherein said second fin forming surface subtends an arc of between 10° and 20°.

6. Die means as defined in claim 5 wherein said first fin forming surface subtends an arc of between 10 and 30°.

7. Die means as defined in claim 1 wherein said second die member shoulder portion further includes a recessed portion adjacent to and communicating with said second fin forming surface, and said first die member shoulder portion further includes a stepped portion adjacent to and communicating with said first fin forming surface, said stepped portion being selectively spaced from said recessed portion upon closure of said first and said second die members to provide a longitudinal relief trough coincident with said first and said second fin forming surfaces and extending therefrom.

8. Die means as defined in claim 7 wherein the width of said trough is substantially equal to the width of said gap between said first and said second fin forming surfaces upon the closure of said first and said second die members.

9. A method of reducing the perimeter of a hollow thin walled member comprising the steps of: pinching a longitudinal portion of the wall of a hollow thin walled member between a pair of selectively spaced, parallel surfaces so located adjacent the periphery of said hollow thin walled member that a central plane lying between and parallel to said parallel surfaces is oriented parallel to the longitudinal axis of said hollow thin walled member and oblique to a radial axis extending from the center of said hollow thin walled member to said central plane to form an obliquely angled fin thereat; and applying an inwardly directed radial force to said fin to cause said fin to fold inwardly against the outer surface of said hollow thin walled member.

10. A method of reducing the perimeter of a hollow thin walled member comprising the steps of: pinching two diametrically opposed longitudinal portions of the wall of a hollow thin walled member along its length between two diametrically opposed pairs of spaced, parallel surfaces, each respective parallel pair of said surfaces being so located adjacent the periphery of said hollow thin walled member that a respective central plane lying between and parallel to a respective parallel pair of said surfaces is oriented parallel to the longitudinal axis of said hollow thin walled member and oblique to a respective radial axis extending from the center of said hollow thin walled member to a respective one of said central planes to form a respective obliquely angled fin at each of said pinched portions; and applying an inwardly directed radial force to each of said fins to cause said fins to fold inwardly against the outer surface of said hollow thin walled member at diametrically opposed locations.

11. A method as defined in claim 10 wherein said fins extend in diverging directions away from a diametrical plane which is normal to a diametrical axis bisecting said fins.

12. A method as defined in claim 10 wherein said fins extend along substantially parallel planes in opposite directions away from a diametrical axis bisecting said fins.

* * * * *

UNITED STATES PATENT AND TRADEMARK OFFICE

CERTIFICATE OF CORRECTION

PATENT NO. : 4,027,519

DATED : June 7, 1977

INVENTOR(S) : Walter Bachle

It is certified that error appears in the above-identified patent and that said Letters Patent are hereby corrected as shown below:

Column 1, line 21, "particlar" should be -- particular --

Column 4, line 11, "brough" should be -- brought --

Column 5, line 23, "now" should be -- not --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*